US005797475A

United States Patent [19]

Bointon et al.

[11] Patent Number: 5,797,475

[45] Date of Patent: Aug. 25, 1998

[54] COIN VALIDATION

[75] Inventors: Richard Guy Bointon, Plymouth; Richard Douglas Allan, Reading; Nicola Marie Funnell, Wokingham, all of United Kingdom

[73] Assignee: Mars Incorporated, McLean, Va.

[21] Appl. No.: 553,465

[22] PCT Filed: Mar. 17, 1995

[86] PCT No.: PCT/GB95/00595

§ 371 Date: Mar. 4, 1996

§ 102(e) Date: Mar. 4, 1996

[87] PCT Pub. No.: WO95/26540

PCT Pub. Date: Oct. 5, 1995

[30] Foreign Application Priority Data

Mar. 29, 1994 [GB] United Kingdom ..... 9406164

[51] Int. Cl.[6] ..... G07D 5/04

[52] U.S. Cl. ..... 194/317; 194/327; 194/331

[58] Field of Search ..... 194/317, 327, 194/331, 344

[56] References Cited

U.S. PATENT DOCUMENTS

| | | | |
|---|---|---|---|
| 2,076,862 | 4/1937 | Patzer | 197/327 X |
| 3,910,394 | 10/1975 | Fujita | 194/331 |

FOREIGN PATENT DOCUMENTS

| | | | |
|---|---|---|---|
| 0543212 | 5/1993 | European Pat. Off. . | |
| 2825094 | 12/1979 | Germany | 194/317 |
| 738244 | 10/1955 | United Kingdom . | |
| 941211 | 11/1963 | United Kingdom . | |
| 1184843 | 3/1970 | United Kingdom . | |
| 2222903 | 3/1990 | United Kingdom | 194/317 |
| 2236609 | 4/1991 | United Kingdom | 194/317 |
| 2250848 | 6/1992 | United Kingdom . | |
| 93/06569 | 4/1993 | WIPO | 194/317 |

*Primary Examiner*—F. J. Bartuska

*Attorney, Agent, or Firm*—Fish & Richardson P.C.

[57] ABSTRACT

Coin validation apparatus comprising a coin path (2, 5, 6); an impact element (14) disposed in the coin path to be contacted by a coin (10); an impact transducer (8) arranged to generate an output signal in dependence on vibration of the impact element (14); and control means (7) for determining a coin parameter based on the output signal; characterised in that the impact element (14) is shaped to create multiple impacts with a passing coin (10).

31 Claims, 5 Drawing Sheets

FIG. 7(a)
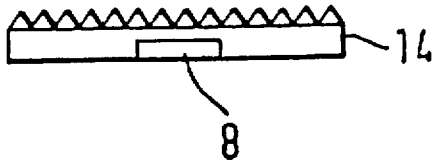
FIG. 7(b)
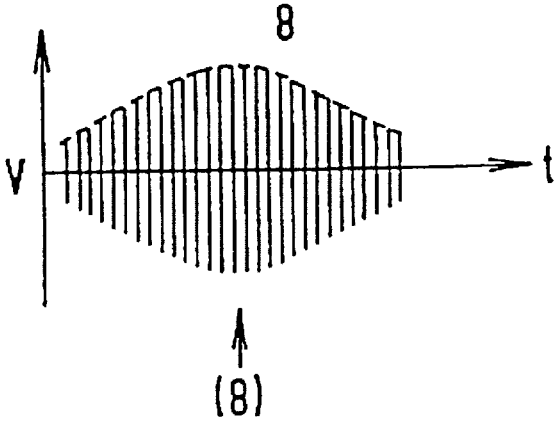
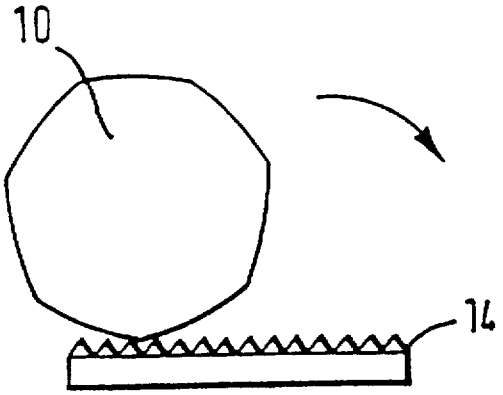
FIG. 8(a)
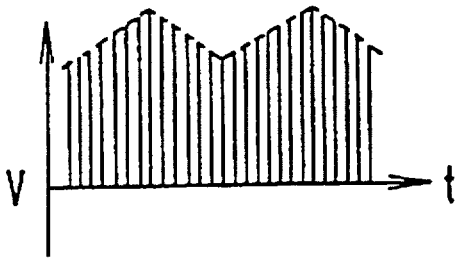
FIG. 8(b)
FIG. 9
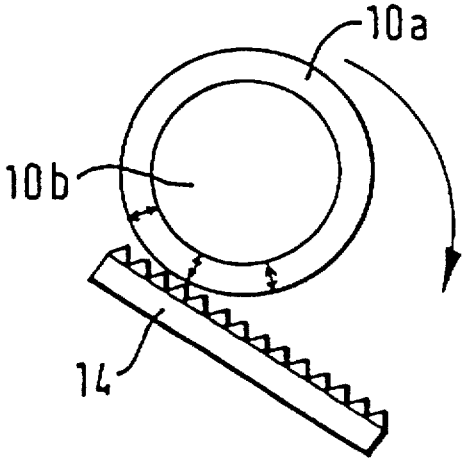

COIN VALIDATION

FIELD OF THE INVENTION

This invention relates to coin validation, and, more particularly, to coin validation using acoustic measurement of coin impact upon an impact member.

BACKGROUND OF THE INVENTION

Historically, validation of coins was originally carried out using mechanical sensors of parameters such as the coin weight, thickness or diameter. Examples of mechanical coin validators are shown in GB-A-1184843 and GB-A-0941211, in both of which mechanical sensing of the coin diameter is employed. In GB-A-0941211, faceted coins are detected by providing serrations on the coin ramp and corresponding serrations on an upper member, spaced from the coin ramp by the diameter of the coin. In GB-A-1184843, the arrangement is for detecting particular milled coins, and serrations are providing on the ramp to engage with the milling on the coins so that, in conjunction with an upper element which engages the top edge of the coins, the ramp controls movement of the coins so that they roll rather than slipping alone the ramp.

More recently, the art has moved on from such mechanical validators. Nowadays, electronic coin validators are almost universally employed.

In the past, various attempts have been made to utilise the vibrations caused by the impact of a coin on an impact element forming part of a coin validation apparatus as an indication of coin validity or denomination. An example is disclosed in EP-A-0543212. The different hardness of different coin materials produces a different vibration spectrum on impact, which can be used to discriminate between coins which are otherwise quite similar; for example, lead counterfeit coins ("slugs") of a similar size and/or weight and/or conductivity to a genuine coin can be distinguished from such coins by the fact that they have a much lower hardness, which results in a different vibration pattern on impact.

In use, an electro acoustic transducer (for example a piezoelectric sensor) is mechanically coupled (directly or indirectly) to the impact element, and some feature of the sensor output is used to validate or discriminate a coin. For example, as in EP-A-0543212, the width of the sensor output pulse caused by the impact may be utilised, or as in GB-A-2236609 the gradient of the pulse may be utilised; alternatively, the peak height of the output pulse, or some other spectral or temporal feature of the output signal, or some combination thereof is used.

To date, such acoustic validation techniques have not been widely employed, because they are sensitive not only to coin material but also to variations in the coin flight and extraneous external noise.

SUMMARY OT THE INVENTION

According to the present invention, in one aspect, there is provided a coin validator comprising an impact member configured to create multiple impacts with a coin.

We have found that the provision of multiple impacts enables the reduction of the effect of variations in the sensor output caused by irregularities in coin flight and/or extraneous noise.

A separate problem in the art is the discrimination of so called bi-color coins; that is to say, coins having an inner disk of a first material surrounded by one or more concentric outer rings of different materials. Approaches to solving this problem to date have provided different sensors to sense different regions of the coin, as described, for example, in GB-A-2266804.

Although such bi-color coins are generally made of one or more metals which may of themselves be hard, for example of a comparable hardness to other coins to be discriminated therefrom, we have found that, surprisingly, such bi-color coins behave on impact in a manner somewhat similar to soft slugs; that is to say, they do not give rise to such sharp, high amplitude oscillations as comparable homogeneous coins, but instead to damped, lower amplitude vibrations on impact. It is believed that this damping is due to acoustic reflections within the coin, at the interface between the different metals.

Accordingly, in another aspect, we make use of this surprising property of bi-color coins by providing a method of discriminating between bi-color coins and relatively hard coins, for example by causing a coin to impact upon an impact member, transducing the vibrations generated in the impact member, and indicating the presence of a bi-color coin when the vibrations caused by the impact are at a relatively low level.

GB-A-2222903 discloses an acoustic coin sensing apparatus in which a weighbridge is used to validate faceted coins (e.g. British 50 p coins). A piezoelectric element is coupled to the weighbridge. It is stated that the rolling of the faceted coin gives rise to a low frequency acoustic component, which can be detected. However, it is stated that a considerable amount of high frequency noise is also generated.

In a further aspect of the invention, we validate multi-faceted coins by creating multiple controlled impacts along a surface, so that the movement of the faceted coin creates an envelope which modulates the peaks due to the multiple impacts. This improves the detection and processing of the envelope due to the faceted coin.

Other aspects, preferred features and embodiments of the present invention will be apparent from the following description and drawings, and from the claims.

The invention will now be described, by way of example only, with reference to the accompanying drawings.

BRIEF DESCRIPTION OF THE DRAWING

FIG. 7*a* illustrates schematically the arrangement of a sensor and impact element according to a further embodiment of the invention; and FIG. 7*b* is a diagram showing a sensor output over time (corresponding to FIGS. 4 and 5) for this embodiment;

FIG. 8*a* illustrates the impact of a multi faceted coin with an impact element according to the first embodiment of the invention; and FIG. 8*b* corresponds to FIGS. 4 and 5 and FIG. 7*b*, and illustrates the sensor output of the first embodiment corresponding to the multi faceted coin; and FIG. 9 is a sketch illustrating a bi-color coin in contact with the impact element of the first embodiment according to a different aspect of the invention.

DETAILED DESCRIPTION

Figure 1:
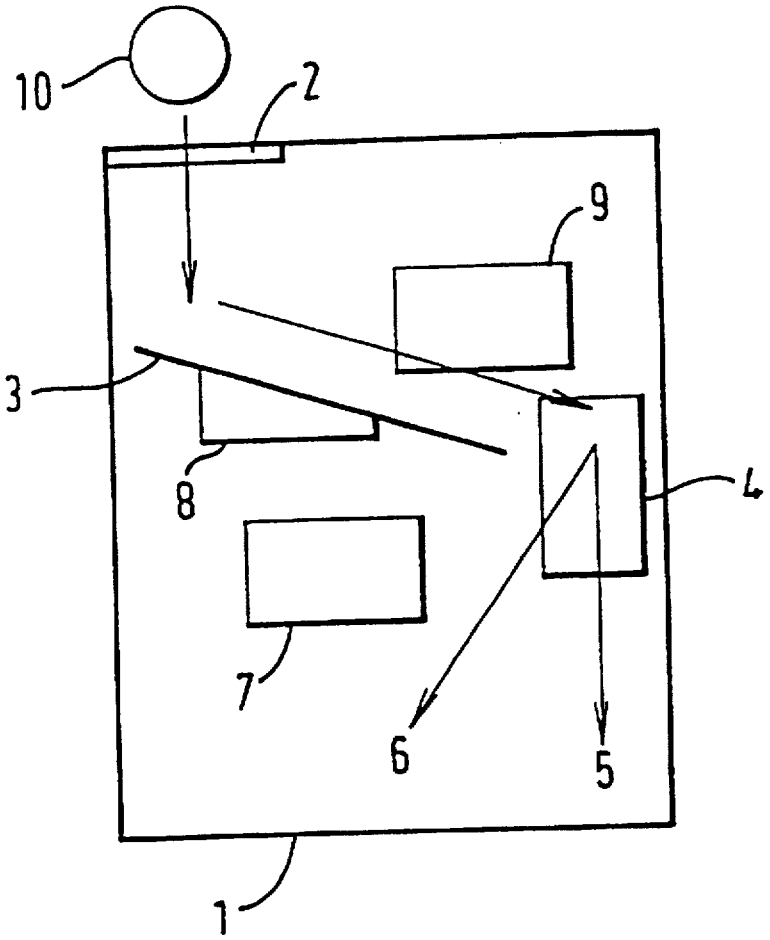
FIG. 1 shows schematically the construction of a coin validator according to an embodiment of the invention.
Figure 2:
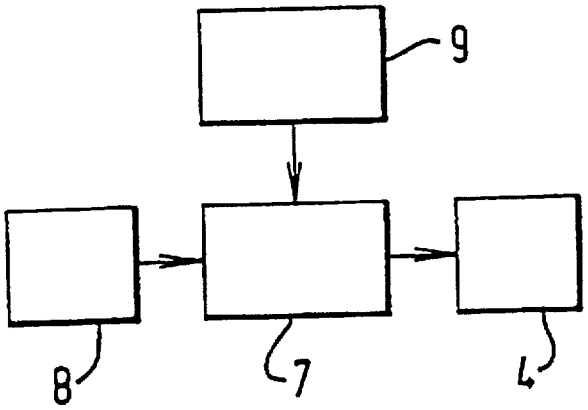
FIG. 2 is a block diagram showing schematically the electrical arrangement of the coin validator of the embodiment of FIG. 1.

Referring to FIGS. 1 and 2, a coin validator according to an embodiment of the invention comprises a housing 1 including a coin inlet 2, from which a coin path including a ramp 3 passes, through a routing gate 4, to one of two destinations 5, 6 in dependence upon the setting of the gate 4.

The gate 4 is controlled by an electronic control unit 7 (for example a microprocessor or microcontroller, or a large scale integrated circuit logic device).

The operation of the control device 7 is responsive to an impact sensor 8 positioned in the coin path. Additional sensors (indicated generally by reference 9) comprising, for example, inductive sensors, may also be provided, to which the control circuit 7 may be responsive.

The impact sensor 8 and any additional sensors 9, are connected to the control circuit 7, via analog to digital convertors (not shown). The control circuit 7 is connected to the gate 4, typically via an electromagnetic actuator (e.g. a solenoid) (not shown) to select the state of the gate 4. The gate 4 may physically be provided by one or more routing devices, and may route the coin on one of two or more paths 5,6 leading to stores for different coin denominations, or to a cash box, or to a reject chute for invalid coins.

With the exception of the impact sensor 8 the foregoing description corresponds broadly to prior art well known from, for example, GB-A-2094008 (in electrical details) or GB-A-2257810 (in mechanical details).

The impact sensor 8 will now be described in greater detail.

Figure 3A:
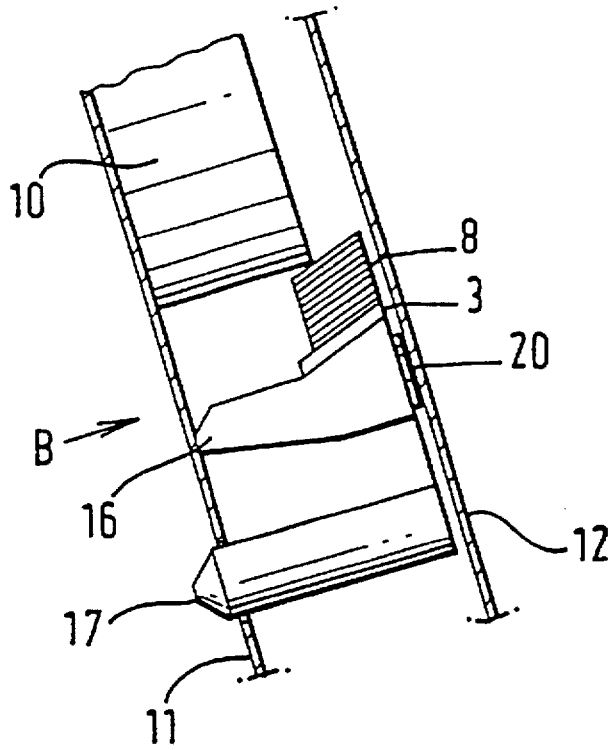
FIG. 3*a* is a cross sectional view through a portion of the coin path of the validator of FIG. 1, looking down the coin path, in the. direction A shown in FIG. 3*b*.

Referring to FIG. 3, FIG. 3*a* is a view down the ramp 3 with a coin 10 on the bottom of the ramp. Defining the coin path are a pair of side walls 11,12. The side walls are mounted in planes inclined to the vertical at some angle (for example, around 12°), so that the coin 10 leans, as shown, on one of the side walls 11. On the opposite side wall 12 is mounted the ramp 3, which includes the impact sensor 8.

Figure 3B:
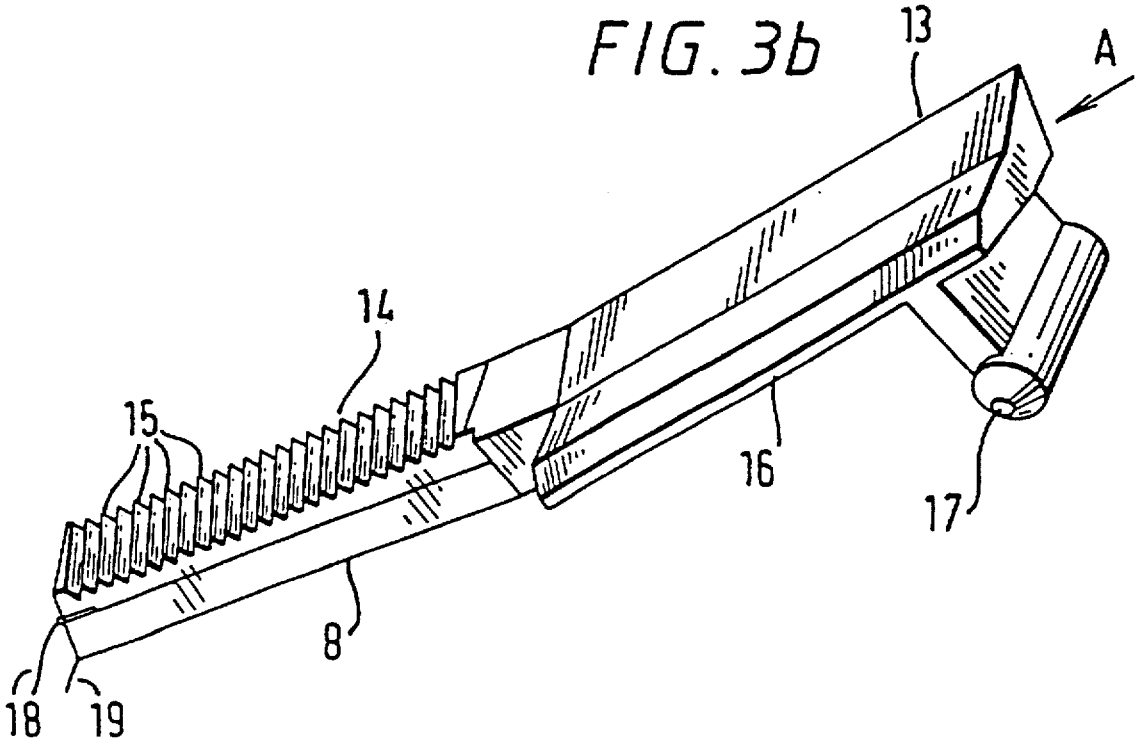
FIG. 3*b* is a view of a coin ramp forming part of the embodiment of FIG. 1, in the direction B shown in FIG. 3*a;*

Referring to FIG. 3*b*, the ramp 3 comprises a first portion 13 and a second portion 14. The second portion acts as an impact element, and carries multiple impact features 15, which in this embodiment are triangular teeth at a regular pitch, to create multiple small, regular impacts with a coin 10 rolling along the ramp 3. The first portion 13 is of a relatively hard material, and acts as a so-called "snubber" as disclosed in GB-A-1482417, or GB-A-2232286.

Also shown are an engagement flange 16 and an engagement stub 17. The flange 16 extends to the wall 11 and the stub 17 engages with a recess in the wall 11, as described in GB-A-2257810 and GB-A-2235558. In this embodiment, as in the above mentioned British patents, the walls 11,12 are hinged together, and may be separated to gain access to the coin rack.

Referring once more to FIG. 3*a* which is a view along he direction A of FIG. 3*b*, the ramp shown in FIG. 3*b* is secured to the wall 12, and the coin engaging surface of the ramp is inclined at an acute angle (for example around 70°) to the wall 12 so that the coin 10 is directed by the ramp into engagement with the wall 11.

Beneath the impact element 14 of the ramp 3 the impact sensor 8 is provided in the form of a elongate bar of piezoelectric (PZT) material with a pair of contact leads 18,19 contacting the upper and lower faces of the bar 8. The upper and lower faces of the bar 8 are silvered, and the contact leads 18, 19 soldered thereto. The upper contact lead 18 is accommodated by providing a recess in the impact element 14.

The impact element 14 is made of a hard material such as INVAR (or another metal, for example steel), and it is preferably formed as an integral whole with the first portion 13. The features 15 may be formed by spark erosion or other machining techniques, or the entire ramp may be formed by a moulding process such as injection moulding.

The sensor 8 is secured to the impact member 14 by a rigid fastening means so as to transmit high frequency vibrations directly to the sensor 8. For example, an epoxy resin bond is used.

Preferably, the materials of the sensor 8 and the impact element 14 are selected such as to match their coefficients of thermal expansion, at least approximately (for example, to within 10%). This avoids the application of a static thermal strain to the sensor 8 (where the fixing between the sensor 8 and the impact member 14 is rigid), or the need for an elastic (and hence non rigid) fixing between the two to take up the differential expansion.

Figure 4A:
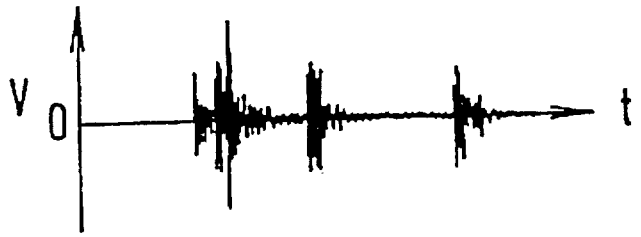
FIG. 4*a* and FIG. 4*b* are diagrams of sensor output (in volts), over time, corresponding to a valid coin and a lead slug, respectively, when tested with apparatus not forming an embodiment of the invention.

FIG. 4*a* shows the response of the sensor 8 which might be obtained if an impact element 14 which lacked the features 15 according to the above described embodiment were employed.

In FIG. 4*a* a genuine coin (a 100 peseta piece) was impacted on such an impact element.

Figure 4B:
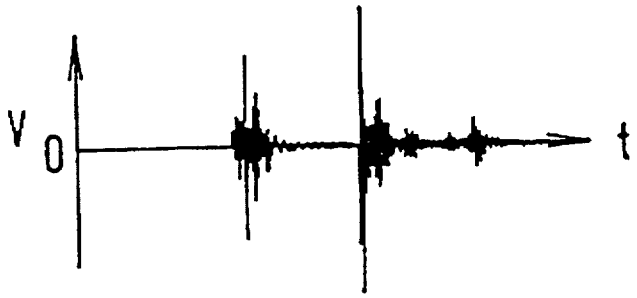

In FIG. 4*b*, a lead slug, confusable in other respects with the coin, was impacted on the same impact element.

In each case, it will be seen that relatively large peaks were obtained. In general, there is more high frequency activity in the signal of FIG. 4*a*, for the genuine coin, which would be expected given the greater hardness of the coin. However, it will be seen that it would be difficult to discriminate between the two on the basis of peak amplitude or duration, as proposed in the prior art.

Figure 5A:
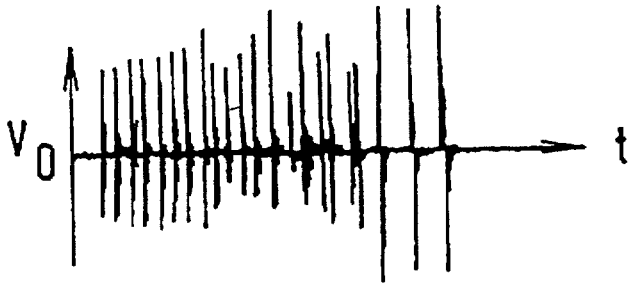
FIGS. 5*a* and 5*b* correspond to FIGS. 4*a* and 4*b* but are the outputs of the sensor in apparatus according to the embodiments of FIGS. 1 to 3.
Figure 5B:
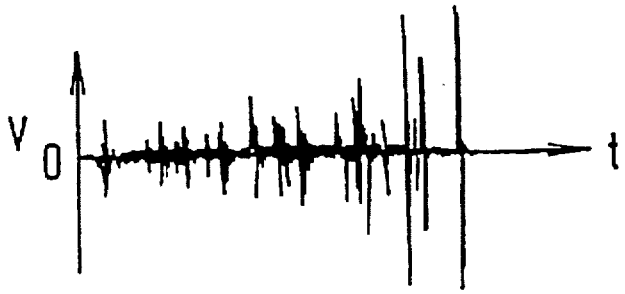

Referring now to FIG. 5, corresponding outputs from the sensor 8 of the above described embodiment of FIGS. 1 to 3 are shown. In FIG. 5*a*, a coin corresponding to that of FIG. 4*a* was impacted with the impact element 14, and in FIG. 5*b* a lead slug to that corresponding to that of FIG. 4*b* was impacted.

It will be seen that in each case, multiple discrete impacts are visible in the output signal over time, corresponding to the impact of the rolling edge of the coin 10 with each of the features 15 in turn. Comparing FIGS. 5*a* and 5*b*, it will be seen that although isolated large impacts are obtained for the lead slug, the genuine coin of FIG. 5*a* gives rise to a much larger number of consistently high, regularly spaced peaks. It is this property of the output of the sensor 8, caused by the multiple impact features 15 of the impact element 14, which makes it possible to employ the sensor 8 to discriminate accurately between coins of different hardness, or between coins and slugs.

It will be apparent that the control circuit 7 could operate in various ways to utilise the output of the sensor 8 to validate coins. Some exemplary methods will now be described.

Figure 6:
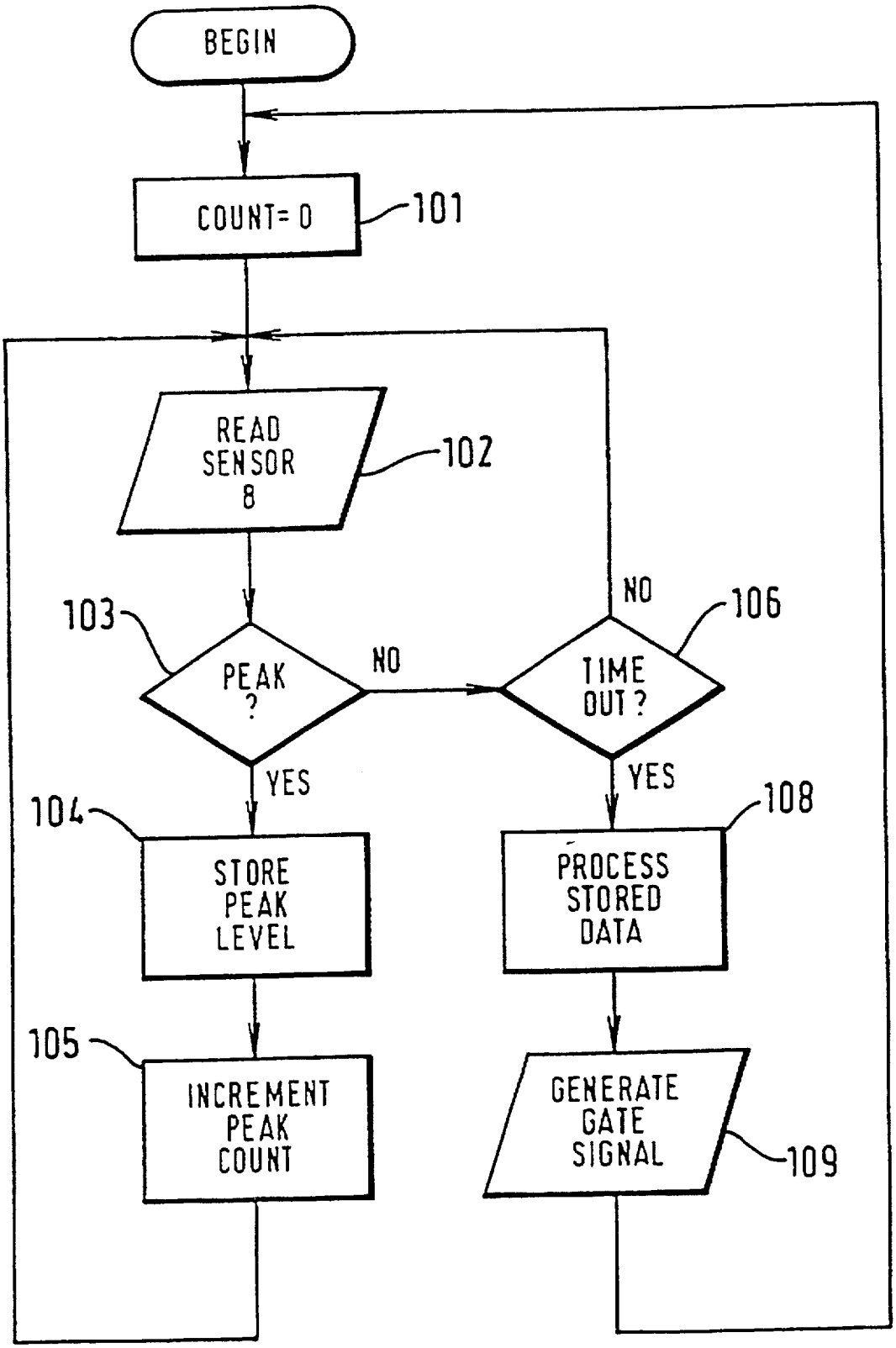
FIG. 6 is a flow diagram showing schematically the process of operation which may be performed by the control circuit forming part of the embodiment of the first embodiment of the invention.

Referring to FIG. 6, a peak count is initialised at zero in a step 101 by the processor 7. The processor 7 then reads the output of the sensor 8 in a step 102, and tests whether a peak is present or not by a conventional "hill climbing" method (e.g. by comparing the just-read value with temporarily stored values representing the immediately preceding value and the value before that, and detecting a peak when the immediately preceding peak is the highest of the three). If a peak is detected in the step 103, the peak amplitude value is stored in a step 104, and the peak count is incremented in a step 105. The processor then returns to the step 102.

If a peak is not detected in the step 103, a time-out test is performed in a step 106 to determine whether an unduly long time has passed since the previous peak was detected. In the event that a time in excess of a predetermined threshold has not yet elapsed, the control circuit 7 returns to the step 102, to continue to attempt to detect a peak.

If the time out test in the step 106 indicates that a time in excess of the predetermined threshold (corresponding to the time taken for a coin to roll between adjacent features 15) has passed, the control circuit 7 proceeds to a processing step 108, to be described in greater detail below, as a result of which the processor generates a control signal to operate the gate 4 in a step 109, depending upon the discriminated identity of the coin.

In one embodiment, the processing step 108 consists in testing the peak amplitudes stored in the step 104, and counting the number which exceeded a predetermined threshold (corresponding to, or lying somewhat above, the level of noise observed in the output of the sensor 8). The number of peaks in excess of this threshold is then compared with a predetermined constant, to determine whether the coin is a valid hard coin or a soft metal slug, and the gate control signal is generated in accordance with whether or not the threshold is exceeded. It will be apparent that it might also be possible to employ upper or lower thresholds to define a window of acceptable coin values, rather than employing a single threshold.

It will also be apparent that in the peak detection step 103 it will be possible to reject (i.e. not store the amplitude of) any peak lying below the noise threshold, in which case the processing step 108 would merely consist of examining the value of the peak count. By way of example, it was found that the level of ambient noise in the sensor output was around 0.2 volts whereas peak amplitudes were up to around 4–5 volts for the above embodiment.

By examination of FIGS. 5*a* and 5*b*, it will be seen that this simple method can lead to valid discrimination between the two outputs, since many more peaks above the noise threshold are observed for the valid coin.

In a further embodiment, in the processing step 108, the control circuit 7 is arranged to add all the stored peak amplitudes to form a total peak amplitude value, which is then compared with a threshold (or as discussed above, upper and lower thresholds) to determine the acceptability of the coin. In a preferred arrangement, the processor adds only those peak amplitudes above the noise threshold.

Once more, by inspecting FIGS. 5*a* and 5*a*, it will be seen that this method leads to reliable discrimination between the two tested coins, since FIG. 5*a* shows a much higher number of high amplitude peaks so that the sum of the peak amplitudes is considerably higher, despite the existence of a small number of high amplitude peaks which are actually observed in FIG. 5*b*.

In a yet further embodiment, in the step 108, the control circuit is arranged to sort the stored peak amplitudes to find the highest five amplitudes and form a sum of the values thereof, and then to find the second highest five amplitudes and form a sum thereof. Then, the ratio between the two sums is taken, and compared with a predetermined threshold to determine acceptability of the coin (or as above, with two predetermined thresholds).

Naturally, numbers other than 5 may be employed; in general, the ratio of the average or sum of the highest $N_1$ to the average or sum of the next $N_2$ coins may be used as a discriminating measure.

Referring once more to FIGS. 5*a* and 5*b* it will be seen that in the case of the invalid coin of FIG. 5*b* although a few relatively large amplitude peaks are observed, most of the peaks are of low amplitude. Thus, the value of the ratio is high. For the valid coin of FIG. 5*a*, however, the peaks are generally of a much more uniform height and therefore the value of the ratio is lower.

This latter method has the advantage of reduced sensitivity to extraneous factors such as temperature which affect the magnitude of the sensor output, since such factors affect all peak magnitudes. The ratio in this case is a measure of the difference in amplitude; the subtractive difference could instead be used.

It will be apparent that each of the above techniques employs an element of statistical processing, in the broad sense, of the output of the sensor 8, the processing step 108 therefore depending upon more than one peak in the output of the sensor 8. Thus, use is made of the multiple impact features 15 which provide a plurality of predictable, uniform impacts and hence peaks in the output of the sensor 8, and enable the reliability of the measures based thereon to be improved by such statistical processing.

In a further embodiment, for each peak (or, preferably, each peak which exceeds a threshold) -the ratio of the height of the peak to the width (in time) of the peak is calculated. For example, the width may be derived by measuring the time over which the peak remains above the threshold (either using a digital timer circuit or, for example, an analog integrator gated by a comparator). The average value of the ratio thus calculated over all peaks, or over a selected subset of peaks, may; be compared with predetermined threshold limits devalidate the coin, since in general soft coins or slugs will exhibit lower amplitude, broader peaks (and hence lower ratios) than harder coins.

In fact the processing step 108 may also take account of the signals from other sensors 9.

The coin may simply be rejected in the event that the above described tests are failed (indicating a soft slug) , or be conditionally accepted if the tests are passed, the final acceptance decision depending upon the outputs of the other sensors 9.

Alternatively, in another embodiment, the measure calculated in the above described embodiments may be used as a indication of a likely coin identity to "pre-condition" or control the operation of the control circuit 7 in processing the outputs of the other sensors 9 (e.g. in selecting particular upper and lower thresholds with which the outputs of the sensors 9 are compared).

Alternatively, the measure computed in any of the above embodiments may be incorporated into a test which depends jointly upon the measure and upon the outputs of other sensors 9 as disclosed, for example, in GB-A-2238152 or GB-A-2254949, both of which are incorporated herein by reference in their entirety.

To determine the effect of various constructional parameters of the above described embodiment of FIGS. 1 to 3, these parameters were modified.

Firstly, the effect of varying the fixing between the sensor 8 and the impact element 14 was tested. It was found that adhesive fixing gave rise to a higher sensor signal output level than physical clamping of the two. Of various types of adhesive, a hard epoxy resin adhesive (for example an E-15 adhesive) was found to give a signal level increase (for example of the order of a factor of 10) over a cyanoacrylate adhesive.

Alternatively, it has been found possible to solder the sensor 8 to the impact element 14, using, for example, ultrasonic soldering.

In either case, it is preferred that the fixing does not significantly soften over the entire range of possible ambient temperature conditions. For example, the above mentioned epoxy resin adhesive had a glass transition or softening temperature above 90° C., and the solder employed had a melting point above 90° C.

These results indicate that the sensor output amplitude is increased by increasing the hardness and rigidity of the fixing between the sensor 8 and the impact element 14.

It would be possible to provide the features 15 extending over the first portion 13 also. However, in practice it is found convenient to use the first portion 13 only for stabilising the coin motion, and not to use the sensor output which corresponds to the time over which the coin is on the first portion 13, since as shown in FIG. 1, the first portion 13 receives the initial impact of the falling coin, which is variable depending upon the force with which the coin is inserted and other factors. Accordingly, there is no great advantage in providing the impact features 15 on the first portion 13.

It is possible to use other materials than INVAR or steel for the second portion 14. It might be possible for the features 15 actually to form part of the sensor 8 itself; however, for piezoelectric sensors, the ceramic material employed is relatively easily damaged and will degrade under multiple coin impacts. Accordingly, it is preferred to use a relatively tough or impact- and wear-resistant material (e.g. INVAR or steel) for the second portion 14. A ceramic material could be employed, but it may be difficult to provide the relatively small features 15 required by conventional ceramic fabrication techniques.

It would be possible to secure a relatively massive mechanical load (for example an absorbent load) to the rear face of the sensor 8, so as to confine vibrations transmitted to the sensor 8 from the impact element 14 within the sensor 8. This might be expected to improve the performance of the sensor 8 with appropriately selected mechanical properties of the load, although initial experiments have not indicated any significant gains.

It is found advantageous to make the thickness of the impact element 14 relatively small (e.g. 1–3 mm), to improve the efficiency with which vibrations are coupled into the sensor 8.

Rather than employing an elongate sensor 8 extending over the whole length of the impact element 14, it is possible to employ a smaller sensor element 8. The effects are indicated schematically in FIG. 7*a*; it was found that the amplitude of the output of the sensors 8 is higher when the coin is in contact with regions of the impact element 14 adjacent to sensor 8, thus applying an envelope over the output of the sensor 8 as shown notionally in FIG. 7*b*.

Although it would be possible, with appropriate processing by the control circuit 7, to utilise the output of such an arrangement, it is therefore preferred to use one sensor extending along the length of the impact element 14 or several sensors at points along the impact element.

When multi faceted coins are to be validated, as shown in FIG. 8*a* (e.g. when the coin path is dimensioned to accept such coins and the control circuit 7 contains data for is validating such coins) it is found that the amplitude of the output of the sensor 8 varies according to the portion of the facet which is in contact with the impact element 14, so as to impose an envelope over the sensor output in a manner characteristic of the multi faceted coin as shown notionally in FIG. 8*b*.

For this reason, if the methods described above with reference to FIG. 6 are to employed the impact element is preferably made at least as long as the circumference of one facet of the coin, so that all points along the length of a facet are present in the output of the sensor 8.

It will be apparent that the output of the sensor could, in this case, also be used to detect multi faceted coins based on this amplitude effect. It is to be noted that the "envelope" would be completely invisible if the coin rolled down a smooth surface.

The effect of varying pitch (that is, the separation between adjacent features 15) was investigated. It was found that, in general terms, increasing the Ditch increased the accuracy with which genuine coins could be separated from soft slugs. For example, for separating the Spanish 100 peseta coin from a lead slug, a pitch of 0.8 mm was found to perform adequately, but a pitch of 1.0 mm performed better.

Increasing the pitch as far as 1.5 mm, however, caused a degradation in the performance because, for the size of coins tested, the pitch was an appreciable fraction of the circumference of the coin so that the curvature of the coin caused it to enter between adjacent features 15 rather than rolling smoothly over the top. A further effect of this is to disturb the coin flight, which may render the readings of the other sensors 9 less reliable.

Thus, it is preferred that the features 15 should be separated by a spacing sufficiently small, relative to the circumference of the coin to be tested, that the impact element 14 acts as a surface over which the coin can roll; in other words, acts as a "flat" surface relative to the curvature of the coin.

In each case tested, the pitch between the features 15 was substantially larger than any milling present on a coin to be tested (by a factor of 4 or 5).

To sum up, a pitch spacing is preferred which is greater than the pitch of the milling on the edge of any coin to be tested, but not so large that the features 15 present obstacles to the rolling of the smallest coin to be tested.

It is preferred to provide a multiplicity of features 15; for example, at least 5 features, and preferably at least 10 features. Conveniently, between 20 and 30 features may be employed.

Although a saw tooth (triangular) profile of the features 15 is indicated, the features could have other profiles; for example, they could be rectangular steps.

Although in FIGS. 3*a* and 3*b* the coin engaging surface of the ramp is shown to be inclined at an acute angle to the wall 12 to direct the coin 1 into engagement with the wall 11, in other embodiments, the impact element 14 and features 15 thereon are provided at a shallow angle (and may in fact be normal to the walls 11, 12 and therefore parallel to the edge of the coin). The same may be true of the ramp immediately prior to the impact element. This is preferable, in reducing the effect of variable geometry of the corners.

Rather than using a piezoelectric sensor, it would be possible to use a silicon strain gauge, or an electromagnetic transducer (e.g. a moving coil). However, a piezoelectric sensor provides a high output amplitude and is thus suitable for use. Some types of piezoelectric sensors (e.g. of PX59 material, available from Philips, Eindhoven, NL) can have low or even zero variation in output level with temperature; this is particularly convenient.

To fasten the impact element to the housing 1, fastening means 20 are provided. In the above embodiments, the sensor 8 is directly coupled to the impact element 14 as closely as possible, so that the impacts are coupled directly to the sensor with little loss through reflections. Accordingly, the nature of the fastening means 20 is not crucial to the operation of the invention. Mechanical fastening means such as rivets may be employed.

It may be preferable to couple the impact element 14 relatively loosely to the housing 1, so that vibrations from external sources are attenuated before reaching the sensor 8. Equally, if the coupling is sufficiently rigid, the sensor 8 may be used for transducing vibrations from other portions of the housing 1, for example for the purpose, disclosed in our earlier UK patent application 9303833.9 filed on 25 Feb. 1993, published as GB-A-2275532. Use of a non-contact transducer (e.g. a microphone) is not excluded.

It will be apparent that many other techniques could be employed by the control circuit 7 to interpret the signal from the sensor 8. For example, spectral filtering could be employed to improve the discrimination between coins; high pass filtering to remove components below 2 kHz reduces the amplitude of the signal from soft slugs, for which much of the energy is present in lower frequencies. Other such spectral techniques could be used; for example high pass and low pass filtered components of the sensor output could be compared.

Equally, time domain filtering techniques could be used to improve the accuracy of the discrimination. Since the output of the sensor 8 consists of a number of well defined peaks at well defined temporal separations, it is possible to employ correlation techniques to extract the information contained in the signal peaks whilst ignoring the noise present between peaks.

Thus, the control circuit 7 could simply perform an auto correlation operation over time on the output of the sensor 8, and use the peak auto correlation coefficient values as a measure of coin validity, or having determined the peak auto correlation and hence the time interval between adjacent pulses, it could use the correlation information to ignore apparent peaks caused by noise but occurring at times in between true impact peaks.

As taught in our earlier application GB-A-2236609, a peak arriving shortly after an earlier peak may be due to an arrival of a second coin. Accordingly, on detecting an apparent peak in between two true impact peaks, in one embodiment, the invention makes no use of any of the detected peaks since confusion, mis-recognition or, ultimately, coin jams may occur where one coin closely follows another. Since the regularly disposed features of the present embodiment produce a well characterised interval between successive genuine peaks arising from a single coin, the present invention enables sensitive detection of arrival of a second coin (which produces peaks at different times).

Rather than employing correlation techniques, other time domain techniques may be used; for example, after detecting a peak above a predetermined threshold height, a dead time period (corresponding to a minimum traverse time of a coin between two adjacent features) may be set, and signal levels within the dead time period ignored for validation purposes; the occurrence of any peaks within the dead time period is then assumed to correspond to the arrival of a further coin.

Equally, information derived from the sensor 8 could be used for purposes other than validating coins directly; for instance, since the interval in time between peaks is inversely proportional to the coin speed, the coin speed can directly be determined from this technique, and used either as indicator of coin validity, or as a value to correct the output of other sensors 9 to take account of speed. The numerical order of the peak auto correlation coefficient is directly proportional to the time interval between adjacent peaks, and hence inversely proportional to the speed of the coin.

Rather than provide an upper contact pin in a recess, where the impact element is made of metal it is possible to use the impact element as an upper contact if it is in electrical contact with the piezoelectric sensor. Electrical contact may be achieved either by soldering the piezoelectric component to the impact element, or by using a conductive adhesive (such as aluminium-loaded epoxy resin) or by using a sufficiently thin layer of adhesive that the piezoelectric component and the impact element are in sufficient contact at spaced points to allow current to flow.

It is possible to use the sensor 8 as an arrival sensor, for the purpose disclosed in GB-A-2168185 (incorporated herein in its entirety by reference), since the peak output of the sensor 8 is high (on the order of 5 volts) and the sensor 8 does not require an external source of power.

It would also be possible to use a separate arrival sensor to enable the control circuit 7 to consider only time portions of the sensor output signal which lie after the initial impact or impacts (since these may depend in an unrepresentative fashion upon the coin flight) and/or on or before the final impacts at the end of, the impact element 14.

In the development of the above described embodiments, a bi-color coin was tested, as shown schematically in FIG. 9. Surprising, it was found that, as compared with a homogeneous coin of similar diameter, mass and hardness, the response of the sensor 8 to the bi-color coin was of reduced amplitude; in other words that the bi-color coin behaved somewhat like a coin of softer material or a slug. Referring to FIG. 9*a*, this appears to be due to acoustic reflections at the interface between the inner metal disk 10*b* and the outer metal ring 10*a*.

Accordingly, it is surprisingly found to be possible to use acoustic validation techniques (preferably, but not exclusively, those described in the above embodiments) to distinguish between a bi-color coin and a homogeneous coin of similar hardness, mass and dimensions.

When tested using the second of the above described processing steps (in which the sum of all peak amplitudes above a noise threshold is compared with a reference threshold) it was found that the values obtained for a bicolor coin lay, on a scale between the values for a homogeneous coin and those for a lead slug, about 20% below those obtained for a homogeneous coin, which is sufficient to make this a valuable technique for discriminating bi-color coins (at least in combination with the output of other sensors 9).

It will be apparent from the foregoing that the above described embodiments are merely examples of the invention in its broader sense. Many alterations and substitutions may be made without departing from the scope of the invention. For example, the geometry of the features 15 may be altered, or they may be spaced in an irregular spacing rather than at a regular pitch.

Equally, analogue components such as peak detector circuits can be used, instead of the corresponding steps performed by the control circuit.

In the foregoing, the term "coin" is intended to encompass not only valid items of currency but also tokens for gaming machines or the like, and counterfeit coins or slugs, as the context requires.

In the foregoing, the term "acoustic" is intended also to encompass frequencies below or above those lying within the human range of audibility.

We claim:

1. Coin validation apparatus comprising a coin path; an impact element disposed in the coin path to be contacted by a coin; an impact transducer arranged to generate an output signal in dependence on vibration of the impact element; and control means for determining a coin parameter based on the output signal; wherein the impact element is shaped to create multiple impacts with a passing coin and wherein the impact element comprises a coin-contacting surface carrying a plurality of coin-impacting features spaced along the coin path.

2. Apparatus according to claim 1, in which the impact element and the impact transducer are separate elements in mechanical communication.

3. Apparatus according to claim 2, in which the impact element is secured directly to the impact transducer.

4. Apparatus according to claim 3, in which the impact element and the impact transducer are secured together by a rigid fixing arranged to transmit relatively high frequency vibrations.

5. Apparatus according to claim 3, in which the impact element and the impact transducer are secured together by adhesive.

6. Apparatus according to claim 5, in which the adhesive is an epoxy resin.

7. Apparatus according to claim 2, in which the thermal coefficients of expansion of the impact element and the impact transducer are at least approximately equal.

8. Apparatus according to claim 2, in which the impact element is made of a more impact resistant material than the impact transducer.

9. Apparatus according to claim 8, in which the impact element is a metal element.

10. Apparatus according to claim 1, in which the impact transducer is a piezo electric transducer.

11. Apparatus according to claim 2, in which the impact transducer is disposed over substantially the entire length of the impact element, along the coin path, over which said multiple impacts occur.

12. Apparatus according to claim 11, in which the impact transducer comprises a single sensor extending along said entire length.

13. Apparatus according to claim 1 in which the control means stores data to determine a parameter of, and the coin path is dimensional to accept, a faceted coin; and in which the coin-impacting features are disposed over a length of said coin path which is at least equal to the circumferential length of a facet of the faceted coin.

14. Apparatus according to claim 1, in which the spacings between the features are substantially equal.

15. Apparatus according to claim 1, in which the spacings between the features are substantially larger than the pitch of any milling of any coin which the coin path is dimensioned to accept and for which the control means stores data for use in determination.

16. Apparatus according to claim 1, in which the spacings between the features are sufficiently small that the coin performs a relatively even rolling motion over said impact element, said multiple impacts being of even, and relatively small, amplitude for any valid coin which the coin path is dimensioned to accept and for which the control means stores data for use in determination.

17. Apparatus according to claim 1, in which the features have inclined sides.

18. Apparatus according to claim 17, in which the features are substantially triangular.

19. Apparatus according to claim 1, in which the coin parameter determined by the control means is the identity or validity of the coin.

20. Coin validation apparatus comprising a coin path; an impact element disposed in the coin path to be contacted by a coin; an impact transducer arranged to generate an output signal in dependence on vibration of the impact element; and control means for determining a coin parameter based on the output signal; wherein the impact element is shaped to create multiple impacts with a passing coin; and wherein the control means is arranged to respond to portions of the output signal corresponding to a plurality of impacts, to perform statistical processing on the output signal, and to be responsive to the sum of a plurality of peak amplitude levels.

21. Coin validation apparatus comprising a coin path; an impact element disposed in the coin path to be contacted by a coin; an impact transducer arranged to generate an output signal in dependence on vibration of the impact element; and control means for determining a coin parameter based on the output signal; wherein the impact element is shaped to create multiple impacts with a passing coin; and wherein the control means is arranged to respond to portions of the output signal corresponding to a plurality of impacts and to be responsive to the difference in amplitude between portions of the output signal of different amplitudes.

22. Apparatus according to claim 21, in which the control means is responsive to the amplitude ratio between said portions of the output signal.

23. Apparatus according to claim 21, in which the control means is arranged not to be responsive to peaks in the output signal which lie below a predetermined level lying above the level of ambient noise in the output signal.

24. Apparatus according to claim 23, in which the control means is responsive to the number of peaks above the predetermined level.

25. A method of validating a coin comprising the steps of:

causing said coin to undergo multiple impacts in a coin path;

transducing said multiple impacts with an impact transducer to generate an output signal;

analyzing temporal portions of the output signal corresponding to said plurality of impacts;

performing statistical processing on said portions of the output signal, to generate a measure signal; and utilizing said measure signal to determine the validity of said coin.

26. The method of claim 25, in which said statistical processing comprises the step of determining a plurality of peak amplitude levels of said portions of the output signal, said peak amplitude levels each corresponding to a said impact.

27. The method of claim 26, in which said statistical processing further comprises the step of calculating a sum of a plurality of said peak amplitude levels.

28. The method of claim 25, in which said statistical processing comprises the step of calculating an amplitude difference between different portions of said output signal.

29. The method of claim 25, in which said statistical processing comprises the step of calculating an amplitude ratio between different portions of said output signal.

30. The method of claim 25, in which the step of statistical processing includes a step of discarding portions of said output signal the amplitudes of which lie below a predetermined level above the level of ambient noise in said output signal.

31. The method of claim 30, in which the step of statistical processing comprises the step of determining the number of said peaks above said determined level.

* * * * *

UNITED STATES PATENT AND TRADEMARK OFFICE

CERTIFICATE OF CORRECTION

PATENT NO. : 5,797,475

DATED : August 25, 1998

INVENTOR(S) : Richard Guy Bointon et al.

It is certified that error appears in the above-identified patent and that said Letters Patent is hereby corrected as shown below:

On the title page, item

[56] References Cited: 2,076,862 4/1937 Patzer "197/327X" should be --194/327X--.

Col. 1, line 23, cancel "alone" and insert --along--.

Col. 3, line 65, cancel "rack" and insert --track--.

Col. 3, line 66, cancel "he" and insert --the--.

Col. 5, line 56, cancel "5a" (second occurrence) and insert --5b--.

Col. 8, line 12, cancel "Ditch" and insert --pitch--.

Signed and Sealed this

Second Day of February, 1999

*Attest:*

*Attesting Officer*

*Acting Commissioner of Patents and Trademarks*